US012523146B2

(12) United States Patent
Aleksandrovich et al.

(10) Patent No.: US 12,523,146 B2
(45) Date of Patent: Jan. 13, 2026

(54) WIRELESS SYSTEM FOR MONITORING DOWNHOLE PARAMETERS

(71) Applicant: Tri-Logic Limited Liability Company, Moscow (RU)

(72) Inventors: Kalabukhov Vladimir Aleksandrovich, Moscow (RU); Yakovlev Arkadiy Vasilyevich, Moscow (RU); Kozhemyachko Roman Vladimirovich, Ramensky agrochemical station (RU)

(73) Assignee: Tri-Logic Limited Liability Company, Moscow (RU)

( * ) Notice: Subject to any disclaimer, the term of this patent is extended or adjusted under 35 U.S.C. 154(b) by 0 days.

(21) Appl. No.: 18/713,724

(22) PCT Filed: Nov. 21, 2022

(86) PCT No.: PCT/RU2022/000344
§ 371 (c)(1),
(2) Date: May 28, 2024

(87) PCT Pub. No.: WO2024/107079
PCT Pub. Date: Mar. 23, 2024

(65) Prior Publication Data

US 2025/0020056 A1 Jan. 16, 2025

(30) Foreign Application Priority Data

Nov. 18, 2022 (RU) ..... 2022130056

(51) Int. Cl.
*E21B 47/12* (2012.01)
*E21B 33/12* (2006.01)

(52) U.S. Cl.
CPC ..... *E21B 47/12* (2013.01); *E21B 33/1208* (2013.01)

(58) Field of Classification Search
CPC .... E21B 47/12; E21B 33/1208; E21B 47/125; E21B 47/13; E21B 47/16
See application file for complete search history.

(56) References Cited

U.S. PATENT DOCUMENTS 6,628,206 B1 * 9/2003 Soulier ..... E21B 47/13 340/854.4
9,951,604 B2 * 4/2018 Hay ..... E21B 17/00
(Continued)

FOREIGN PATENT DOCUMENTS

WO WO-0165066 A1 * 9/2001 ..... E21B 17/003

*Primary Examiner* — Steven A MacDonald
(74) *Attorney, Agent, or Firm* — Rivka Friedman

(57) ABSTRACT

A wireless system for monitoring downhole parameters in a well, in which the walls are cased with metal tube string, comprises a downhole transceiver arrangement lowered into the well and a transceiver mounted on the wellhead. One input or output of the wellhead transceiver is connected to the metal structure of the wellhead, and the second input or output is connected to the grounding device. A downhole transceiver arrangement comprises a contact element for electrical contact with a casing string, downhole instrument module, downhole pumping equipment or tubing electrically isolated from the string of casing metal tubes using at least one centralizer. The downhole instrument module comprises a dielectric insert, measuring sensors, control devices, receiving and transmitting device, and is designed to receive or transmit a signal from or to a transceiver located on the wellhead. This ensures that the operating modes of wells are monitored and optimized.

7 Claims, 2 Drawing Sheets

(56) References Cited

U.S. PATENT DOCUMENTS 10,962,673 B2 * 3/2021 Lemenager ..... G01V 3/38
2001/0033164 A1 * 10/2001 Vinegar ..... E21B 34/16 324/312
2002/0029883 A1 * 3/2002 Vinegar ..... E21B 34/066 166/250.03
2002/0036085 A1 * 3/2002 Bass ..... E21B 43/16 166/250.12
2002/0043369 A1 * 4/2002 Vinegar ..... H04B 13/02 166/250.07
2002/0121366 A1 * 9/2002 Bass ..... E21B 34/066 166/65.1
2002/0126021 A1 * 9/2002 Vinegar ..... E21B 17/003 166/242.6
2003/0024704 A1 * 2/2003 Hirsch ..... E21B 17/003 166/372
2003/0042016 A1 * 3/2003 Vinegar ..... G01V 11/002 166/250.11
2003/0042026 A1 * 3/2003 Vinegar ..... E21B 33/1294 166/387
2003/0048697 A1 * 3/2003 Hirsch ..... E21B 41/0085 340/855.8
2003/0051881 A1 * 3/2003 Vinegar ..... E21B 34/16 166/66.6
2003/0056952 A1 * 3/2003 Stegemeier ..... E21B 43/00 166/250.12
2003/0066652 A1 * 4/2003 Stegemeier ..... E21B 43/32 166/73
2003/0066671 A1 * 4/2003 Vinegar ..... E21B 47/12 363/178
2003/0164240 A1 * 9/2003 Vinegar ..... E21B 41/0085 137/155
2003/0227393 A1 * 12/2003 Vinegar ..... E21B 34/066 340/854.3
2004/0060703 A1 * 4/2004 Stegemeier ..... E21B 47/13 166/310
2006/0044155 A1 * 3/2006 Le Briere ..... E21B 47/13 340/854.3
2007/0039738 A1 * 2/2007 Fenton ..... E21B 47/09 166/368
2015/0009041 A1 * 1/2015 van der Ende ..... E21B 47/13 340/854.9
2015/0292320 A1 * 10/2015 Lynk ..... E21B 47/135 367/82
2017/0328198 A1 * 11/2017 Van Der Ende ..... G01V 11/002
2020/0271809 A1 * 8/2020 Al-Ali ..... G01V 1/50
2020/0291769 A1 * 9/2020 Torbett ..... H04B 1/10
2025/0020056 A1 * 1/2025 Aleksandrovich ..... E21B 33/1208

* cited by examiner

WIRELESS SYSTEM FOR MONITORING DOWNHOLE PARAMETERS

TECHNICAL FIELD

This technical solution relates to the field of data transmission and parameter monitoring, in particular to a wireless system for monitoring downhole parameters. This solution is designed to create a two-way wireless communication channel and monitor the parameters in wells drilled through rocks and cased with metal tubes (e.g. wells for oil and gas production).

PRIOR ART

Traditionally, cable systems have been used to transmit information between downhole equipment and the wellhead. However, the use of such systems poses the risks of damaging the cable during installation and operation, which results in the loss of communication and requires costly repairs.

A method of transmitting information from a well through an electrical communication channel and apparatus for its implementation are known from RU2528771C2, published on Sep. 20, 2014. That method for transmitting information from a well via an electrical communication channel provides for exciting electric current in a string of metal tubes located in the well and separated into a top and a bottom parts by a dielectric insert, and recording a voltage change at the surface caused by the current pulsation in the tube. In this case, the useful signal is the change in voltage at the terminals of the receiving cylindrical coil and represents a function of the alternating current flowing in the tube excited by means of an alternating EMF applied to a dielectric insert. A disadvantage of this method for transmitting the information from the wells cased with metal tubes is the need to install a dielectric insert for electrical separation of the casing tube string, which can be done only at the construction of the well or during its workover.

A method of implementing an electromagnetic communication channel in the form of a tube-to-ground system is known from U.S. Pat. No. 7,114,561B2, published on Oct. 3, 2006. The main element of this communication system is an induction choke, which is located on the outside of the string (and mounted around the casing string before it is secured with cement). To protect against external damage, it is hardened with epoxy. A means is provided to electrically insulate the well elements from ground connection. This is achieved by using electrical isolators on the sub-surface gate valves. A major disadvantage of such system is the impossibility to repair and remove the device once the wellbore has been cemented, as well as the complexity of process operations to mount the transceiver on the casing string and run it into the well.

SUMMARY OF THE INVENTION

The claimed technical solution is aimed at solving the technical problem of monitoring and optimizing the operating modes of oil and gas wells. The monitoring and optimization of parameters are ensured by implementing downhole systems for operational monitoring of oil and gas well parameters. However, the widespread use of such systems is hampered by the process risks associated with running the data cable downhole. A wireless system for monitoring downhole parameters created to solve this problem uses the elements of the well structure, such as production string, tubing, and components of downhole pumping equipment hanger, to create a communication channel. The particular embodiments of the proposed solution are characterized in the dependent claims.

The technical result achieved by solving the above technical problem is the ability to monitor the well parameters by operating a wireless system for monitoring downhole parameters. An additional technical result is the implementation of the purpose.

The claimed technical result is achieved by implementing a wireless system for monitoring downhole parameters according to the first embodiment (wherein the walls of the well are cased with metal tube string), which comprises the following:

- a transceiver mounted on the wellhead, wherein one input or output is connected to the metal structure of the wellhead, and the second input or output is connected to a grounding device, and enabled to receive or transmit a signal from or to the downhole instrument module;
- a downhole transceiver arrangement comprising a contact element for electrical contact with a casing string, downhole instrument module, downhole pumping equipment or tubing electrically isolated from the string of casing metal tubes using at least one centralizer made of dielectric material, wherein:
- the downhole instrument module comprises a dielectric insert, measuring sensors, actuators, receiving and transmitting device, and is designed to receive or transmit a signal from or to a transceiver located on the wellhead.

The claimed technical result is achieved by implementing a wireless system for monitoring downhole parameters according to the second embodiment (wherein the walls of the borehole are cased with metal tube string), which comprises the following:

- a transceiver mounted on the wellhead, wherein one input or output is connected to the metal structure of the wellhead, and the second input or output is connected to a grounding device, and enabled to receive or transmit a signal from or to the downhole instrument module;
- a downhole transceiver arrangement comprising a contact element for electrical contact with a casing string, downhole instrument module, downhole pumping equipment, or tubing electrically isolated from the string of casing metal tubes using at least one centralizer made of dielectric material and a packer, wherein:
- a downhole instrument module comprises a dielectric insert, measuring sensors, actuators, receiving and transmitting device, and is designed to receive or transmit a signal from or to a transceiver located on the wellhead.

In a particular embodiment for implementing the proposed system according to two embodiments, the grounding device is located from the casing string at a distance that enables to detect the potential difference between the grounding device and the casing string.

In a particular embodiment for implementing the proposed system according to two embodiments, the wellhead transceiver is enabled to transmit a signal by changing the potential of the casing string relative to the grounding device, wherein the change in potential begins to propagate along the entire length of the string and, after a time 't', reaches the downhole transceiver arrangement, and the losses during signal transmission from the upper closing point (A) to the lower closing point (B) cause a potential difference between points A and B, which is detected by the receiver of the downhole instrument module.

In a particular embodiment for implementing the proposed system according to two embodiments, the downhole instrument module is enabled to transmit a signal by changing the potential of point A of the casing string relative to point B, wherein the change in potential begins to propagate along the entire length of the string and, after a time 't', reaches the wellhead, and a potential difference, which occurs between the casing string and the grounding device, is detected by the wellhead transceiver.

In a particular embodiment for implementing the proposed system according to two embodiments, the contact element is installed at a distance of more than 5 meters to the edge of casing metal tubes.

A particular embodiment for implementing the proposed system according to the second embodiment is characterized in that the packer is electrically conductive and is enabled to provide electrical contact with the casing string.

DESCRIPTION OF DRAWINGS

The embodiment of the invention will be described below in accordance with the accompanying drawings, which are presented to explain the essence of the invention and in no way limit the scope of the invention. The following drawings are attached to the application.

DETAILED DESCRIPTION OF THE INVENTION

The following detailed description of this invention embodiment provides numerous details of the embodiment to ensure a clear understanding of the present invention. However, to those skilled in the art, it will be obvious how the present invention could be used, whether with or without these details of its embodiment. In other cases, the well-known methods, procedures, and components have not been described in detail to avoid overcomplicating the understanding of this invention's features.

In addition, the above presentation will make it clear that the invention is not limited to the presented embodiment. Numerous possible modifications, changes, variations, and substitutions, that retain the essence and form of this invention, will be obvious to those skilled in the art.

The well walls are cased with metal tube string (casing string), which is secured with cement (cement ring (5)). The well can be drilled through the rocks (6) from the ground surface (wellhead) to the bottom hole (maximum available well depth). A string of casing tubes should have no electrical discontinuities along its entire length up to the wellhead.

Figure 1:
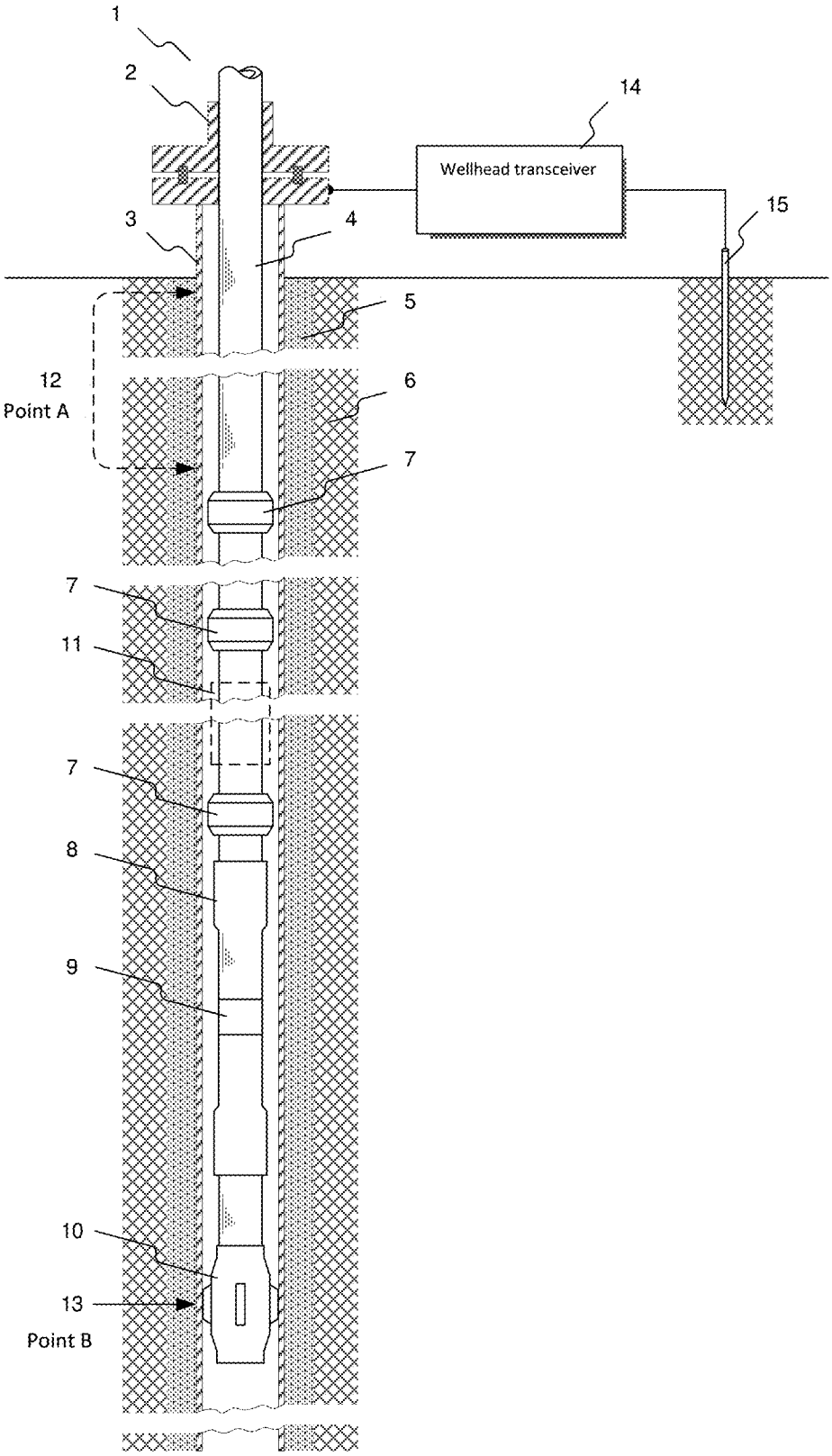
FIG. 1 illustrates the layout diagram of a wireless system for monitoring downhole parameters.

According to the first embodiment (FIG. 1), a wireless system for monitoring downhole parameters comprises a transceiver (14) mounted on the wellhead (1) and a downhole transceiver arrangement comprising a contact element (10) for electrical contact with a casing string, downhole instrument module (8), downhole pumping equipment (11) or tubing (4) electrically isolated from the string of casing metal tubes (3) using at least one centralizer (7) made of dielectric material.

According to the second embodiment (FIG. 2), a wireless system for monitoring downhole parameters comprises a transceiver (14) mounted on the wellhead (1) and a downhole transceiver arrangement comprising a contact element (10) for electrical contact with a casing string, downhole instrument module (8), downhole pumping equipment (11) or tubing (4) electrically isolated from the string of casing metal tubes (3) using at least one centralizer (7) made of dielectric material and a packer (16).

A transceiver (14) mounted on the wellhead (1), wherein one input or output is connected to the metal structure of the wellhead (2) and a second input or output is connected to a grounding device (15), and enabled to receive or transmit a signal from or to the downhole instrument module (8); The grounding device (15) is located from the casing string at a distance that enables to detect the potential difference between the grounding device and the casing string.

A downhole transceiver arrangement, comprising a contact element (10) for electrical contact with a casing string, downhole instrument module (8), downhole pumping equipment (11), or tubing (4) electrically isolated from the string of casing metal tubes (3) using at least one centralizer (7) made of dielectric material, is run into the well.

A contact element (10) is installed under the downhole instrument module so that the distance to the edge of the casing string (3) is more than 5 meters. If it is necessary to install the contact element (10) at a distance of less than 5 meters from the edge of the casing string (3), then a tubing (4) of 5 or more meters is installed below the lower contact element (10).

A downhole instrument module (8) comprises a dielectric insert (9), measuring instruments and sensors (for example, but not limited to, a flow meter, moisture meter, pressure sensor, temperature sensor, etc.), a receiving and transmitting device, a self-contained power system and, when needed, the control devices (for example, but not limited to, valves, samplers, etc.) A downhole instrument module (8) using a dielectric insert (9) conventionally divides casing string (3) into conventionally "lower" and "upper" parts. The housing of the downhole instrument module (8) should not have any electric contact with the casing string (3).

A downhole transceiver arrangement between point A (12) and point B (13) represents a downhole instrument module, tubing (4), or other downhole pumping equipment (11) that is electrically isolated from the casing string (3) for a length of 10 to 100 meters. A closing point of tubing with the casing string A (12) can be formed at any place located above the electrically insulated part up to the wellhead (1). The electrical isolation from the casing string (3) is provided by centralizers (7) made of dielectric material. The number of centralizers (7) and their overall dimensions are determined by the design and curvature of the well.

A downhole transceiver arrangement can be installed in the well both with and without the downhole pumping equipment, and it can be used during the process operations in the well in order to monitor parameters and control the process.

Figure 2:
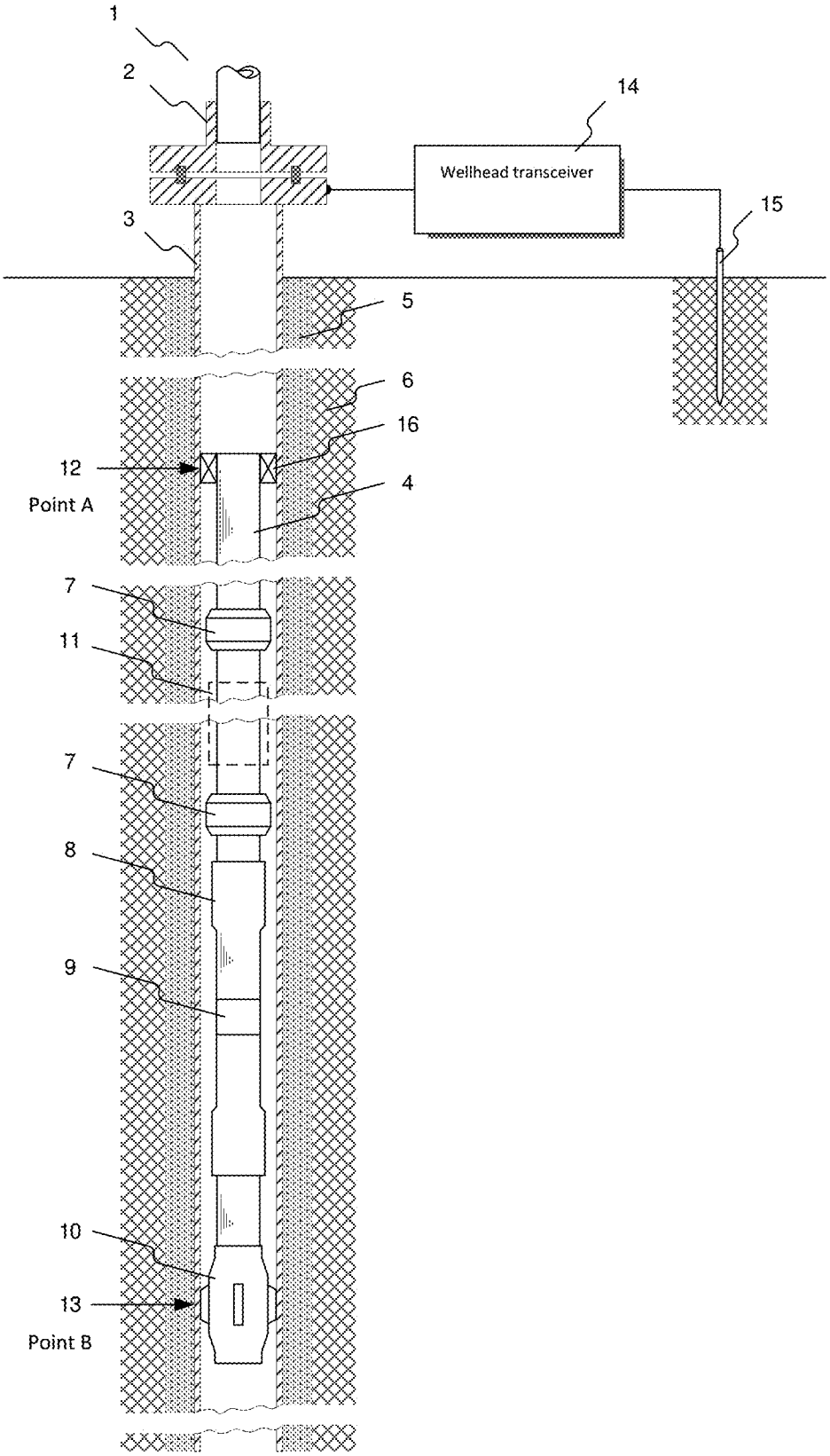
FIG. 2 illustrates the layout diagram of a wireless system for monitoring downhole parameters with a packer.

A downhole transceiver arrangement may be used without a string of tubing (FIG. 2). In this case, the arrangement is installed in the well using the packer, and the rest of the string of tubing is removed; in the present embodiment, the packer is electrically conductive and provides electrical contact with the string at point (A).

Signal transmission. A downhole instrument module (8) transmits the signal by changing the potential of the "upper" part (point A (12)) of the casing string (3) relative to the "lower" part (point B (13)), wherein the change in potential begins to propagate along the entire length of the string and after a time 't' reaches the wellhead (1). The receiver (14) on the wellhead (1) receives a signal on the change in the string potential relative to the grounding device (15).

Signal reception. When a command is transmitted from the wellhead (1) to the downhole instrument module (8), the wellhead transmitter (14) changes the potential of the casing string (3) relative to the grounding device (15), and the change in potential begins to propagate along the entire length of the string and, after a time 't', reaches the downhole transceiver arrangement and the losses during signal transmission from the point (A) (12) to the point (B) (13) cause a potential difference between points A (12) and B (13), which is detected by the receiver of the downhole instrument module (8).

These application materials disclosed the preferred embodiment of the claimed technical solution, which should not be used to limit its other, particular embodiments that are within the scope of the claimed legal protection and are obvious to those skilled in the relevant art.

We claim:

1. A wireless system for monitoring downhole parameters in a well, wherein the well's walls are cased with a metal casing string, the system comprising:

a transceiver mounted on a wellhead, the transceiver having one input and one output, wherein one of the input or output is connected to a metal structure of the wellhead, and the other input or output is connected to a grounding device, and the transceiver being configured to receive or transmit a signal from or to a downhole instrument module;

a downhole transceiver arrangement configured to be lowered into the well and comprising the downhole instrument module, a contact element for electrical contact with the casing string, wherein the contact element is installed under the downhole instrument module, downhole pumping equipment and tubing electrically isolated from the casing string using at least one centralizer made of dielectric material:

wherein the downhole instrument module comprises a dielectric insert, one or more measuring sensors, one or more actuators, a receiving and transmitting device, and is configured to receive or transmit a signal from or to the transceiver located on the wellhead.

2. A wireless system for monitoring downhole parameters in a well, wherein the well's walls are cased with a metal casing string, the system comprising:

a transceiver mounted on a wellhead, the transceiver having one input and one output, wherein one of the input or output is connected to a metal structure of the wellhead and the other input or output is connected to a grounding device, and the transceiver being configured to receive or transmit a signal from or to a downhole instrument module;

a downhole transceiver arrangement configured to be lowered into the well and comprising the downhole instrument module, a contact element for electrical contact with the casing string, wherein the contact element is installed under the downhole instrument module, downhole pumping equipment and tubing electrically isolated from the casing string using at least one centralizer made of dielectric material, and a packer located at the top of the downhole transceiver arrangement, configured to secure the downhole transceiver arrangement to the casing string:

wherein the downhole instrument module comprises a dielectric insert, one or more measuring sensors, one or more actuators, a receiving and transmitting device, and is configured to receive or transmit a signal from or to the transceiver located on the wellhead.

3. The system according to claim 1 or 2, wherein the grounding device is located from the casing string at a distance that enables to detection of the potential difference between the grounding device and the casing string.

4. The system according to claim 1 or 2, wherein the wellhead transceiver is configured to transmit a signal by changing the potential of the casing string relative to the grounding device, wherein the change in potential is configured to propagate along the entire length of the string and, after a time 't', reach the downhole transceiver arrangement, and such that the losses during signal transmission from an upper closing point (A) to a lower closing point (B) cause a potential difference between points A and B, and wherein the receiver of the downhole instrument module is configured to detect the potential difference between points A and B.

5. The system according to claim 1 or 2, wherein the downhole instrument module is configured to transmit a signal by changing the potential of an upper closure point A of the casing string relative to a lower closure point B, wherein the change in potential is configured to propagate along the entire length of the string and, after a time 't', reach the wellhead, and wherein the wellhead transceiver is configured to detect a potential difference, between the casing string and the grounding device.

6. The system according to claim 1 or 2, wherein the contact element is configured to be installed at a distance of more than 5 meters to the edge of casing string.

7. The system according to claim 2, wherein the packer is electrically conductive and is configured to provide electrical contact with the casing string.

* * * * *